United States Patent [19]

Salice

[11] 4,226,001

[45] Oct. 7, 1980

[54] PIVOTAL JOINT WITH POSITION-STABILIZING SPRING

[75] Inventor: Luciano Salice, Carimate, Italy

[73] Assignee: Arturo Salice S.p.A., Cantu, Italy

[21] Appl. No.: 23,324

[22] Filed: Mar. 23, 1979

[30] Foreign Application Priority Data

Apr. 4, 1978 [IT] Italy ..... 21956 A/78

[51] Int. Cl.[3] ..... B14C 29/00

[52] U.S. Cl. ..... 16/145; 161/164; 161/167

[58] Field of Search ..... 16/163, 164, 145, 180, 16/182, 184, 167

[56] References Cited

U.S. PATENT DOCUMENTS

| | | | |
|---|---|---|---|
| 3,590,420 | 6/1971 | Salice | 16/164 |
| 3,744,086 | 7/1973 | Salice | 16/164 |
| 4,065,829 | 1/1978 | Lautenschlager | 16/163 X |

FOREIGN PATENT DOCUMENTS

| | | |
|---|---|---|
| 923122 | 11/1970 | Italy . |
| 987526 | 6/1972 | Italy . |

*Primary Examiner*—Werner H. Schroeder
*Attorney, Agent, or Firm*—Karl F. Ross

[57] ABSTRACT

Two relatively swingable members interconnected by a pair of hinge straps are biased into either of two predetermined relative positions, 90° apart, by a hairpin-type leaf spring bearing upon a projection of one hinge strap while being wound about a pintle engaged by the other hinge strap. The leaf spring consists of at least two nested plies of sheet steel, which may or may not be interconnected at one end, each having a thickness which is less than that of a single-ply spring of like material having the same degree of elasticity. The innermost ply is supported by a bushing of plastic material surrounding the associated pintle.

6 Claims, 6 Drawing Figures

PIVOTAL JOINT WITH POSITION-STABILIZING SPRING

FIELD OF THE INVENTION

My present invention relates to a pivotal joint of the type wherein two relatively swingable members are interconnected by a pair of hinge straps and are resiliently urged into either of two predetermined relative positions by a generally hairpin-shaped leaf spring coacting with one of these hinge straps.

BACKGROUND OF THE Invention

A joint of this general type has been disclosed in my prior U.S. Pat. Nos. 3,864,786 and 3,477,086. The leaf spring conventionally employed are strips of sheet steel of generally V-shaped configuration with two diverging legs interconnected by a bight portion whose radius of curvature should be as small as possible. Sheet steel having the requisite elasticity, however, is of limited malleability which imposes a certain minimum value upon the ratio between radius of curvature and sheet thickness.

OBJECT OF THE INVENTION

The object of my present invention, therefore, is to provide an improved spring construction for a pivotal joint of the aforedescribed type which satisfies the requirement for a small radius of curvature at the bend between two V-legs while urging these legs apart with sufficient force to hold the interconnected members in their desired relative position.

SUMMARY OF THE INVENTION

This object is realized, in accordance with my present invention, by providing a generally hairpin-shaped leaf spring consisting of two or more nested and substantially coextensive steel plies of substantially the same thickness elastically reinforcing one another to provide a degree of elasticity which with a single-ply spring of like material could be attained only at the expense of an increased sheet thickness and correspondingly enlarged radius of curvature. In the case of a two-ply spring, the plies could be interconnected at an end of one of its legs remote from its bight portion.

The small radius of curvature of such a leaf spring allows it to be readily bent around a pintle engaged by one of the hinge straps. Pursuant to a further feature of my invention, however, the pintle embraced by the leaf spring may be surrounded by a bushing of synthetic resin inserted into the bight portion of the spring. Such a bushing not only increases the effective diameter of the spintle but also, if made of a material having a certain inherent resiliency (e.g. polyacetal), further enhances the elasticity of the spring.

BRIEF DESCRIPTION OF THE DRAWING

The above and other features of my invention will now be described in detail with reference to the accompanying drawing in which.

SPECIFIC DESCRIPTION

Figure 1:
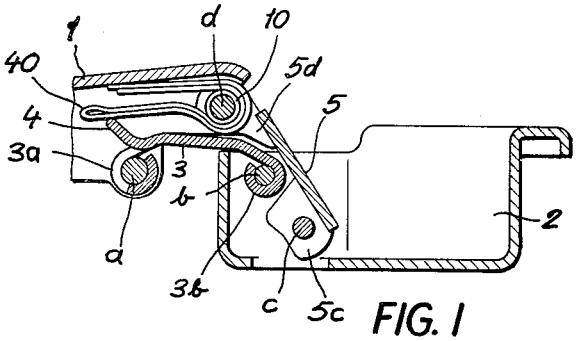
FIG. 1 is a sectional view of a joint according to my invention, shown in one limiting position.
Figure 6:
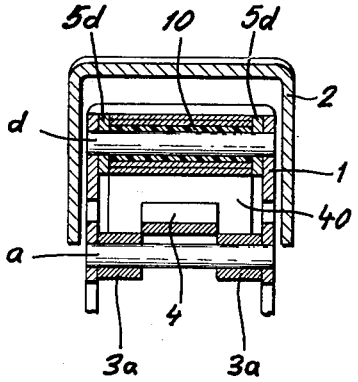
FIG. 6 is a cross-sectional view taken on the line VI—VI of FIG. 2.
Figure 2:
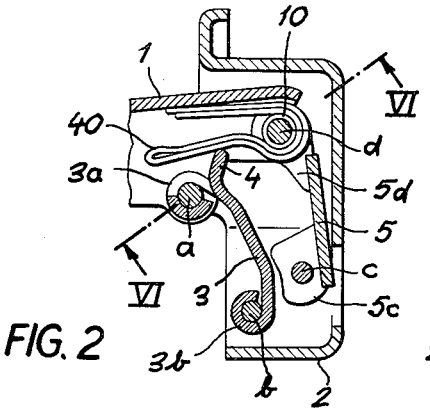
FIG. 2 is a view similar to FIG. 1, showing the joint in its other limiting position.

The joint illustrated in FIGS. 1 and 2 is of the general type disclosed in my prior U.S. Pat. No. 3,744,086, comprising two relatively swingable members 1 and 2 which may be secured to respective components (not shown) such as a cabinet frame and a door to be rotated through an arc of 90°. Members 1 and 2 are interconnected by two hinge straps 3 and 5, strap 3 having eyes 3*a* and 3*b* respectively pivoted to members 1 and 2 by pintles a and b traversing these eyes. Strap 5 has bifurcate extremities with pairs of prongs 5*c* and 5*d* lying close to the sidewalls of the generally U-shaped member 1 which is bracketed by the similarly shaped member 2 as best seen in FIG. 6; the two pairs of prongs are traversed by pintles c and d secured to members 2 and 1, respectively.

Figure 4:
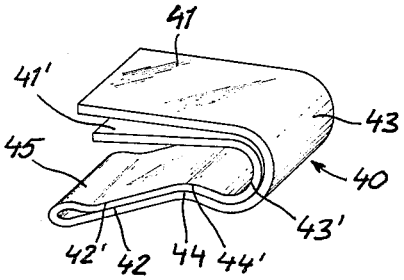
FIGS. 4 and 5 are axonometric views of two modified leaf springs usable in the joint of FIGS. 1 and 2.

Pintle d, spanning the sidewalls of inner member 1, is surrounded by a bushing 10 of plastic material which in turn is embraced by a bight portion of a leaf spring generally designated 40. Spring 40 consists of two plies of sheet steel which, as best seen in FIG. 4, form two divergent legs 41, 41″ and 42, 42′ interconnected by part-cylindrical bends 43, 43′, constituting the aforementioned bight portion, with an inversion of curvature at 44 and 44′ between these bends and leg portions 42, 42′. The two plies are part of a unitary strip of sheet steel bent back upon itself at the free end 45 of lower leg 42, 42′; the bend 45 is not subjected to significant deformation and can therefore be given a radius of curvature substantially smaller than that of bends 43, 43′.

The upper leg 41, 41′ bears upon the top wall of member 1 while the lower leg 42, 42′ rests on the tip of a lug 4 integral with strap 3, this lug being bent away from eye 3*a* so as to project beyond the pivotal axis of pintle a while pointing in a direction away from the opposite pivot b. As will be apparent from a comparison of FIGS. 1 and 2, the lower spring leg tends to retain the strap 3 and, with it, the member 2 in either of the two illustrated limiting positions relative to member 1.

Figure 3:
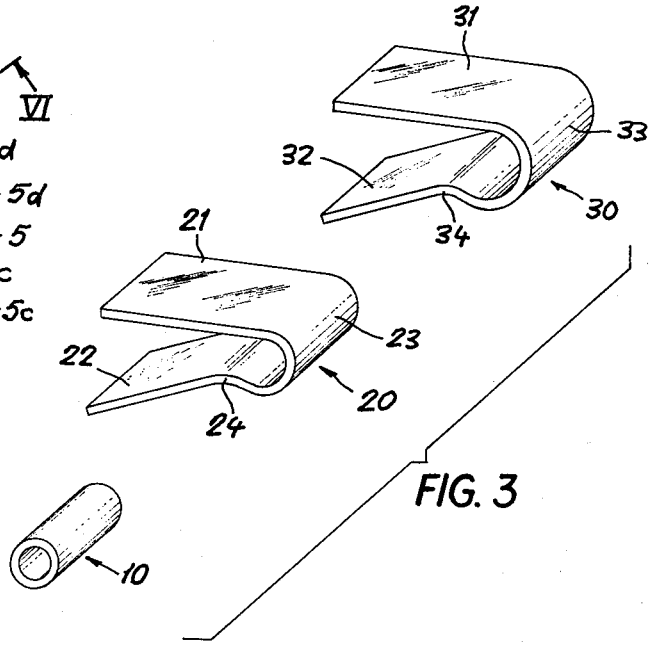
FIG. 3 is an exploded axonometric view of a leaf spring and a bushing included in the joint of FIGS. 1 and 2.

As shown in FIG. 3, the unitary leaf spring 40 may be replaced by a similar spring consisting of two separate hairpin blades 20 and 30, the inner blade 20 having legs 21, 22 and a bend 23 with an inversion zone at 24 while the outer blade 30 has legs 31, 32, a bend 33 and an inversion zone 34.

Figure 5:
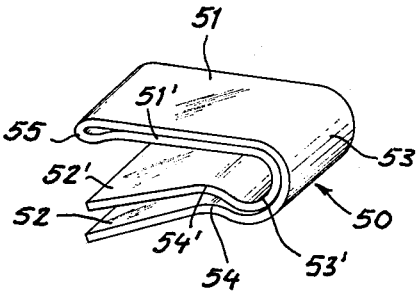

In FIG. 5 I have illustrated another unitary leaf spring 50 with leg portions 51, 51′ and 52, 52′, bends 53, 53′ and inversion zones 54, 54′, the inner and outer plies being interconnected by a small bend 55 at the free end of the upper leg 51, 51′.

Evidently, substitution of spring 20, 30 or spring 50 for the spring 40 in the joint of FIGS. 1, 2 and 6 will not alter the operation of the latter.

It will be understood that the leaf springs shown in the drawing may be modified by the addition of one or more further plies, integral or not with those shown, allowing the use of even thinner foils and shorter radii of curvature at their bight portions.

I claim:

1. A pivotal joint for two relatively swingable components, comprising:

a first member adapted to be secured to one of said components;

a second member adapted to be secured to the other of said components;

an articulated linkage interconnecting said members, said linkage including a pair of hinge straps each having respective ends joined by pivot means to both said members, said pivot means including a pintle on said first member surrounded by a bushing of resilient material; and a generally hairpin-shaped leaf spring with a first leg and a second leg interconnected by a bight portion closely embracing said bushing, said first leg bearing upon said first member, said second leg bearing upon a projection of one of said hinge straps for biasing said members into either of two relative positions, said leaf spring consisting of at least two nested and substantially coextensive steel plies of substantially the same thickness elastically reinforcing one another.

2. A pivotal joint as defined in claim 1 wherein said leaf spring is folded back upon itself at an end of one of its legs remote from said bight portion to form said plies.

3. A pivotal joint as defined in claim 1 wherein said projection is a lug extending beyond a pivotal axis defined by an end of said one of said hinge straps and said first member, said lug pointing away from the opposite end of said one of said hinge straps.

4. A pivotal joint as defined in claim 1, 2 or 3 wherein said other of said hinge straps has a bifurcate extremity engaging said pintle and bracketing said bight portion.

5. A pivotal joint as defined in claim 1, 2 or 3 wherein said resilient material is a synthetic resin.

6. A pivotal joint as defined in claim 5 wherein said synthetic resin is a polyacetal.

* * * * *